US007262786B2

(12) United States Patent
Kang et al.

(10) Patent No.: US 7,262,786 B2
(45) Date of Patent: Aug. 28, 2007

(54) IMAGE ALIGNING METHOD FOR THERMAL IMAGING PRINTER

(75) Inventors: Kyung-pyo Kang, Suwon-si (KR); Hyoung-il Kim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 132 days.

(21) Appl. No.: 11/022,633

(22) Filed: Dec. 28, 2004

(65) Prior Publication Data

US 2005/0140770 A1 Jun. 30, 2005

(30) Foreign Application Priority Data

Dec. 31, 2003 (KR) ..... 10-2003-0101585

(51) Int. Cl.
*B41J 3/60* (2006.01)

(52) U.S. Cl. ..... 347/171; 400/188; 347/104; 347/218

(58) Field of Classification Search ..... 347/171, 347/218, 104; 400/188
See application file for complete search history.

(56) References Cited

U.S. PATENT DOCUMENTS

| | | | | |
|---|---|---|---|---|
| 5,360,276 | A | 11/1994 | Petermann | 400/55 |
| 6,290,319 | B1 | 9/2001 | Boleda | 347/18 |
| 6,296,405 | B1 * | 10/2001 | Brewington et al. | 400/188 |
| 6,447,182 | B2 * | 9/2002 | Brewington et al. | 400/188 |
| 6,601,952 | B2 * | 8/2003 | Sugioka et al. | 347/104 |
| 6,801,233 | B2 | 10/2004 | Bhatt et al. | 347/175 |
| 2005/0078139 | A1 * | 4/2005 | Kang et al. | 347/19 |

FOREIGN PATENT DOCUMENTS

| | | |
|---|---|---|
| JP | 62-255171 | 11/1987 |
| JP | 01-242273 | 9/1989 |
| JP | 08-025703 | 1/1996 |
| JP | 2001-310503 | 11/2001 |
| JP | 2001-3310073 | 11/2001 |
| JP | 2002-337328 | 11/2002 |
| JP | 2003-156974 | 5/2003 |

* cited by examiner

*Primary Examiner*—Huan Tran
(74) *Attorney, Agent, or Firm*—Roylance, Abrams, Berdo & Goodman, L.L.P.

(57) ABSTRACT

An image aligning method for a thermal imaging device includes picking up a thermal imaging medium that has a first surface and a second surface on which printing operations may be performed respectively from a medium container. An edge of the medium is fed a first distance from a heating element of a thermal printhead to a printing path. An image is formed on the first surface of the medium while proceeding the medium through the printing path. The thermal printhead is rotated to face the thermal printhead toward the second surface of the medium. The edge of the medium is fed the first distance from the heating element. An image is formed on the second surface of the medium while feeding the medium through the printing path.

13 Claims, 8 Drawing Sheets

IMAGE ALIGNING METHOD FOR THERMAL IMAGING PRINTER

BACKGROUND OF THE INVENTION

This application claims the benefit under 35 U.S.C. § 119(a) of Korean Patent Application No. 2003-101585, filed on Dec. 31, 2003, in the Korean Intellectual Property Office, the entire disclosure of which is hereby incorporated by reference.

FIELD OF THE INVENTION

The present invention relates to an image aligning method for a thermal imaging printer. More particularly, the present invention relates to an image aligning method for a thermal imaging printer using a duplex thermal imaging medium.

DESCRIPTION OF THE RELATED ART

A thermal imaging printer can be divided into a printer using a medium that reveals a predetermined color in response to heat, and a printer using an ink ribbon that transfers a predetermined color onto a sheet of medium in response to heat in order to print images on normal medium. Since the printer using the ink ribbon should include a driving device in order to drive the ink ribbon, the structure of the printer becomes complex and raises its price. Also, the ink ribbon should be replaced continuously, and, therefore, the printing cost per sheet of medium also increases.

Referring to FIG. 1, ink layers 12 and 13 of predetermined colors are formed on both surfaces of a base sheet 11 of a thermal imaging medium 10, that is, on a first surface and a second surface. The ink layers 12 and 13 may be formed as a single layer of a mono-color ink or multi-layers to represent two or more colors, respectively. For example, the ink layer 12 on the first surface includes two layers for representing magenta (M) and cyan (C) colors, and the ink layer 13 on the second surface is formed of a single layer for representing yellow (Y) color. It is desirable that the base sheet 11 is a transparent material. U.S. Pat. No. 6,801,233 discloses an example of a thermal imaging medium 10.

In the thermal imaging printer using the thermal imaging medium 10, a thermal printhead (TPH), in which heating elements are disposed perpendicularly to a direction of movement of the thermal imaging medium, is used. To print in duplex using one TPH, printing of the first surface of the medium is performed, and then, the printing operation is performed on the second surface of the medium again using the TPH. After printing both surfaces of the medium, the color image is visible from the surface of the medium.

When the TPH is rotated in order to print the image on the second surface after printing the image on the first surface, the medium and the TPH should be aligned, otherwise, the color printing operation can be inferior.

Therefore, a need exists for a method of aligning the medium when the printing operation of the second surface is performed after performing the printing operation on the first surface of the medium.

SUMMARY OF THE INVENTION

The present invention provides a method of aligning printing mediums for performing duplex printing.

According to an aspect of the present invention, a method of aligning images for a thermal imaging device is provided (a) picking up a thermal imaging medium that has a first surface and a second surface, on which printing operations may be performed respectively, from a medium container, and feeding an edge of the medium a first distance from a heating element of a thermal printhead to a printing path; (b) forming an image on the first surface of the medium while moving the medium through the printing path; (c) rotating the thermal printhead so that the thermal printhead may face the second surface of the medium; (d) feeding the edge of the medium the first distance from the heating element; and (e) forming an image on the second surface of the medium while feeding the medium through the printing path, wherein a distance between an edge detection sensor that is attached at the thermal printhead and the edge of the medium is measured to make the first distances in step (a) and step (d) substantially equal.

Step (a) may include picking up the medium; feeding the picked-up medium to the printing path; detecting the edge of the medium using the edge detection sensor; and feeding the medium a third distance when the edge is detected using a second distance between the edge detection sensor and the thermal printhead that is stored in advance, so that the medium may be fed the first distance from the heating element of the thermal printhead.

According to and aspect of the present invention, the edge detection sensor is attached on the feeding roller side of the thermal printhead, and the third distance may be a sum of the first distance and the second distance.

The feeding of the medium as much as the first distance by detecting the edge of the medium may include printing a test pattern on the medium by feeding the medium the third distance from the point when the edge is detected; detecting the test pattern using the edge detection sensor by feeding the medium; and when the test pattern is detected, measuring a feeding distance of the medium until the test pattern is detected; and storing the measured distance as the second distance.

Step (d) may further include feeding the medium to the printing path by driving the feeding roller; detecting the edge of the medium using the edge detection sensor; and feeding the medium a fourth distance when the edge is detected, wherein the fourth distance is obtained by subtracting the second distance from the first distance.

BRIEF DESCRIPTION OF THE DRAWINGS

The above and other features and advantages of the present invention will become more apparent by describing in detail exemplary embodiments thereof with reference to the attached drawings in which.

Throughout the drawings, like reference numerals will be understood to refer to like parts, components and structures.

DETAILED DESCRIPTION OF EXEMPLARY EMBODIMENTS

Hereinafter, an image aligning method for a thermal imaging device according to exemplary embodiments of the present invention will be described with reference to the accompanying drawings.

Figure 1:
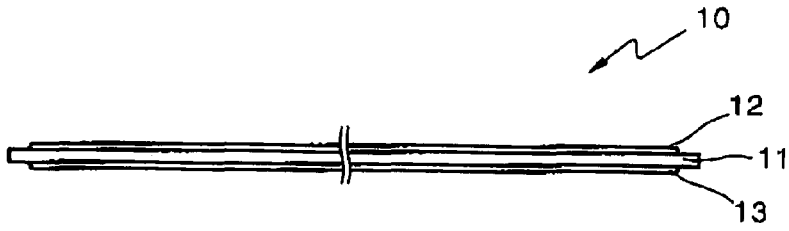
FIG. 1 is a cross-sectional view illustrating a structure of a thermal imaging medium used in an image aligning method according to the present invention.
Figure 2:
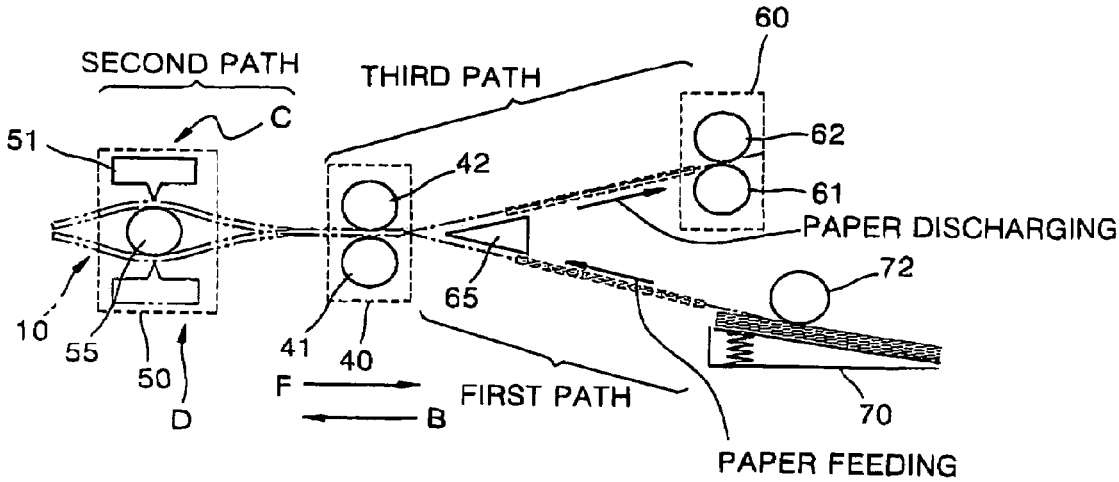
FIG. 2 is a schematic block diagram of a thermal imaging apparatus of the image aligning method according to the present invention.

FIG. 2 is a view illustrating an image aligning method for the thermal imaging apparatus according to exemplary embodiments of the present invention.

As shown in FIG. 2, the image aligning method includes at least a first path, a second path, and a third path, and conveys a thermal imaging medium 10 through the paths. The first path is a medium supplying path to supply the medium 10 to the second path. The second path is a region where the medium 10 is backfed in arrow B direction to align the medium 10, and fed forward in arrow F direction to print thereon. In addition, the third path is a region where the medium 10 with a printed first surface is located to return to the second path and the medium 10 with two printed surfaces is passed to discharge finally.

A medium guide 65 is disposed between the first path and the third path. The medium guide 65 guides the medium 10 to move from the first path to the second path, and guides the medium 10 from the second path to move toward the third path. Also, the medium guide 65 prevents the medium 10 on the second path from moving toward the first path, and guides the medium 10 on the first path to move toward the second path. The structure and design of the medium guide 65 are generally known in the art, thus detailed descriptions for these elements are omitted.

In the second path, an image is formed by an image forming unit 50. The image forming process may be performed two times or more. However, in exemplary embodiments of the present invention, the image forming process is performed twice for a first surface and a second surface of the medium 10. Before forming the images on the first surface and the second surface of the medium 10, positions or locations of a thermal printhead (TPH) 51 and a platen roller 55 in the image forming unit 50 should be determined in advance. That is, for example, when the image is formed on the first surface of the medium 10, the TPH 51 should be located at position C in FIG. 2, and when the image is formed on the second surface of the medium 10, the TPH 51 should be located at position D. Preferably, the change of location or position of the TPH 51 is made by rotating the platen roller 55 and the TPH 51 that are connected to a rotary shaft of the platen roller 55. The change of TPH 51 location is made when an interruption between the TPH 51 and the medium 10 does not occur. For example, the position of the platen roller 55 and the TPH 51 may be changed before the medium 10 is supplied from the first path, or when the medium 10 is conveyed to the third path during the image forming process of the first surface.

When the medium 10, the first surface of which includes the image formed thereon, is backfed to the second path, the image forming process for the second surface is performed by the TPH 51, the position of which is changed. In the above process, the medium 10 moves gradually by the conveying unit 40, and moves further when the image forming on the second surface is completed and the medium is to be discharged through the medium discharging unit. The conveying unit 40 includes a feeding roller 41 that conveys the medium, and an idle roller 42 that pushes the medium entering therebetween toward the feeding roller 41.

Reference numeral 70 denotes a medium container, and reference numeral 72 denotes a pickup roller to supply the medium.

The medium discharging unit 60 includes a discharging roller 61 and an idle roller 62. One roller may be disposed to perform two functions of the discharging roller 61 and the pickup roller 72.

Figure 3:
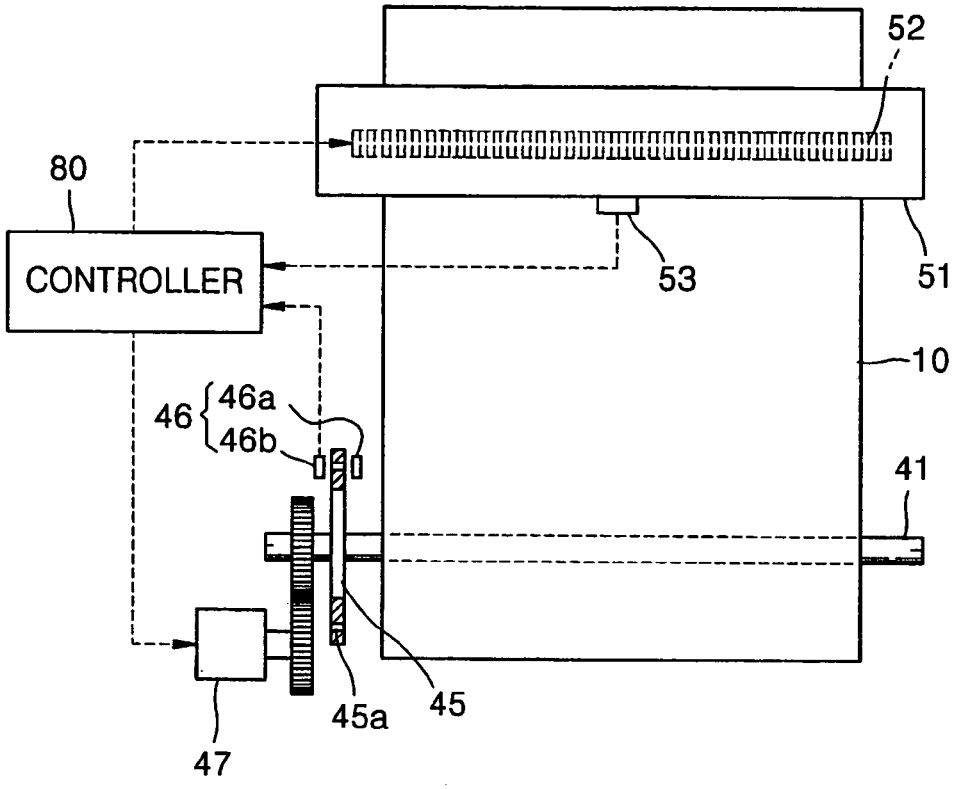
FIG. 3 is a schematic plan view illustrating a structure of an apparatus having the image aligning method according to the present invention.
Figure 4:
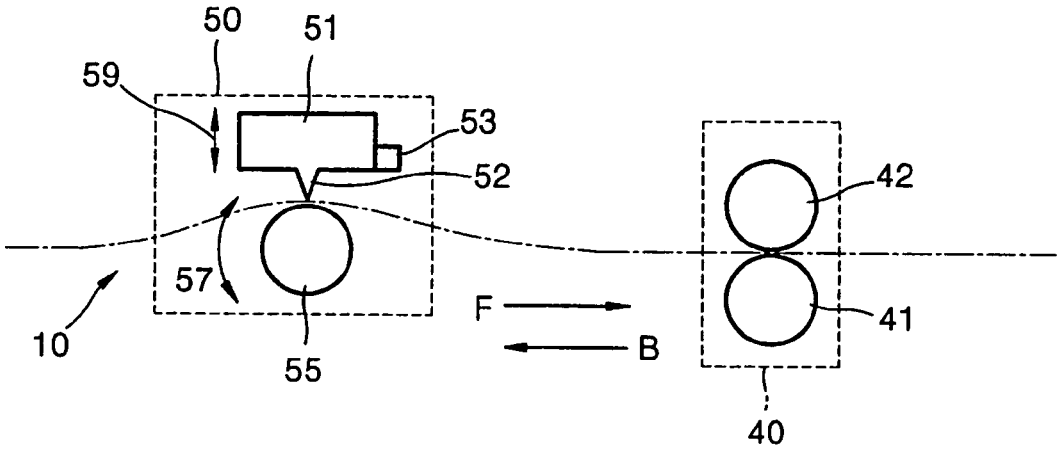
FIG. 4 is a side elevational view illustrating the apparatus of FIG. 3.

FIG. 3 is a schematic plan view illustrating a structure of an apparatus using the image aligning method with the thermal imaging apparatus according to a preferred embodiment of the present invention. FIG. 4 is a schematic side view of the apparatus shown in FIG. 3.

Referring to FIGS. 3 and 4, the thermal imaging medium 10 entering between the platen roller 55 and the TPH 51 is controlled by the feeding roller 41. An edge detection sensor 53, for example, an optical sensor to detect an edge of the medium 10 is installed at the TPH 51.

The medium 10 is conveyed in the direction indicated by arrow B, that is, in the backfeeding direction, and in the direction indicated by arrow F direction, that is, in the printing processing direction. An encoder disc wheel 45 is mounted on a circumference of the feeding roller 41. Slits 45*a* are formed on an edge of the encoder disc wheel 45 at predetermined intervals, and rotary encoder sensors 46 including a light emitting unit 46*a* and a light receiving unit 46*b* are mounted on both sides of the encoder disc wheel 45. The light emitting unit 46*a* of the rotary encoder sensor 46 emits the light at a predetermined speed, and the light receiving unit 46*b* generates pulse signals whenever it receives the light through the slit 45*a*. A controller 80 counts the pulse signals to measure the conveyed distance of the medium 10 that is conveyed by the feeding roller 41, and drives the driving motor 47 to control the conveyed distance of the medium 10 that is conveyed by the feeding roller 41.

The optical sensor 53 is disposed on a lower portion or a side of the TPH 51. A plurality of heating elements 52 are disposed at a predetermined resolution under TPH 51.

The thermal imaging printer includes a rotating unit 57 that rotates the TPH 51 and the platen roller 55 through a 180° angle to print the image on the second surface after performing the printing operation on the first surface of the medium 10. A vertical moving unit 59 moves the TPH 51 away from the printing path or pushes the TPH 51 toward to the printing path.

The image aligning method for the thermal imaging device will be described with reference to accompanying drawings.

Figure 5:
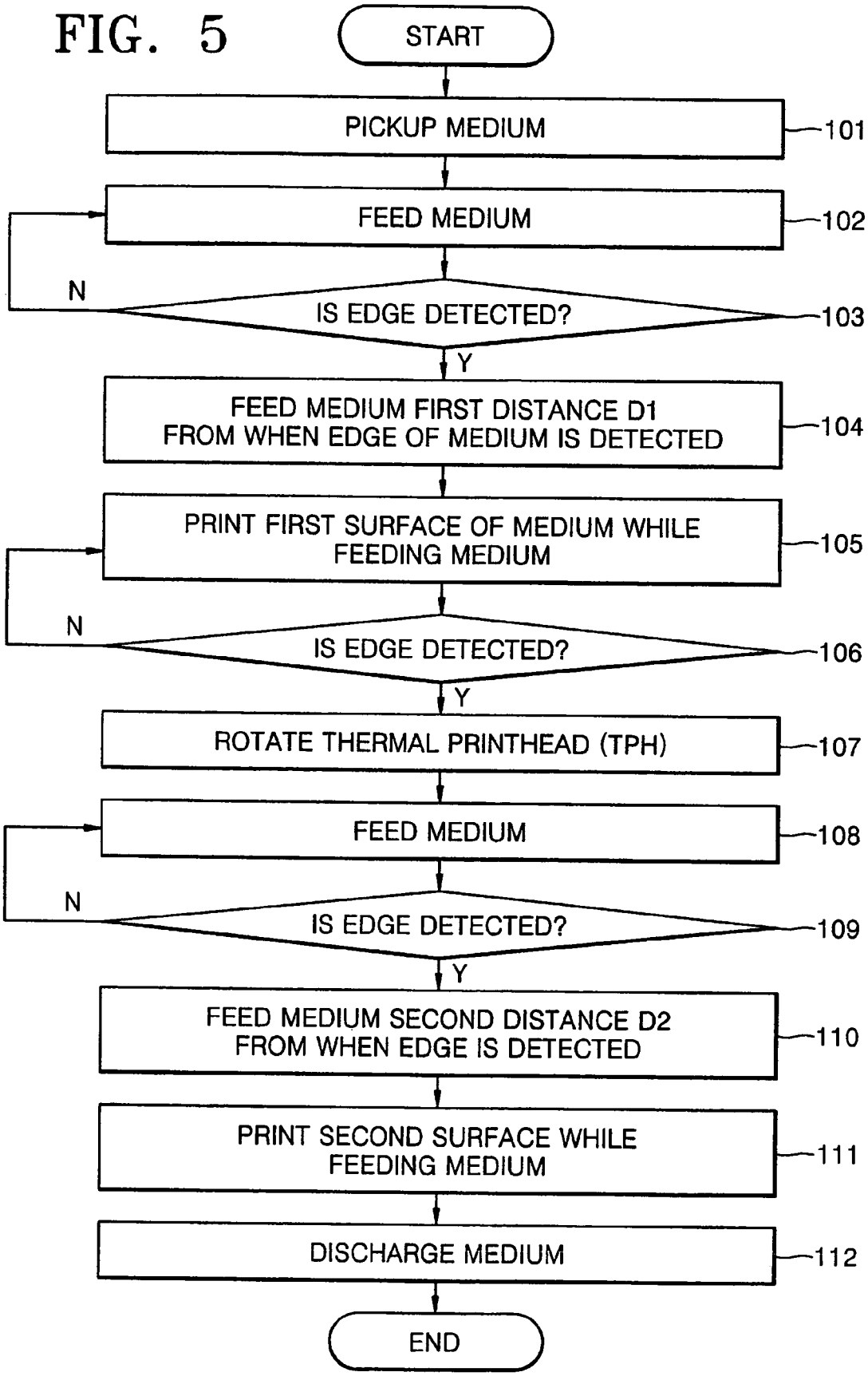
FIG. 5 is a flow chart illustrating the image aligning method according to a preferred embodiment of the present invention.

FIG. 5 is a flow chart describing the image aligning method for the thermal imaging printer according to the present invention. FIGS. 6A through 6D are schematic views illustrating the image aligning processes shown in FIG. 5.

In step 101, when a command for printing is input into the controller 80, a medium 10 is picked up from the medium container 70 by the pickup roller 72 and the medium 10 proceeds to the first path.

In step 102, the medium 10 entering the first path is supplied to the feeding roller 41 by the medium guide 65, and the feeding roller 41 makes the medium 10 second path. Here, it is desirable that the TPH 51 is separated from the platen roller 55 by a predetermined height. The medium 10 entering the second path should proceed to a predetermined location for performing the printing operation. Thus, the rotation of the rotary encoder wheel 45, which is installed on the circumference of the feeding roller 41, is detected by the rotary encoder sensor 46. In addition, when a generated pulse signal is transmitted to the controller 80, the controller 80 counts the pulse signals to measure the conveyed distance.

Figure 6A:
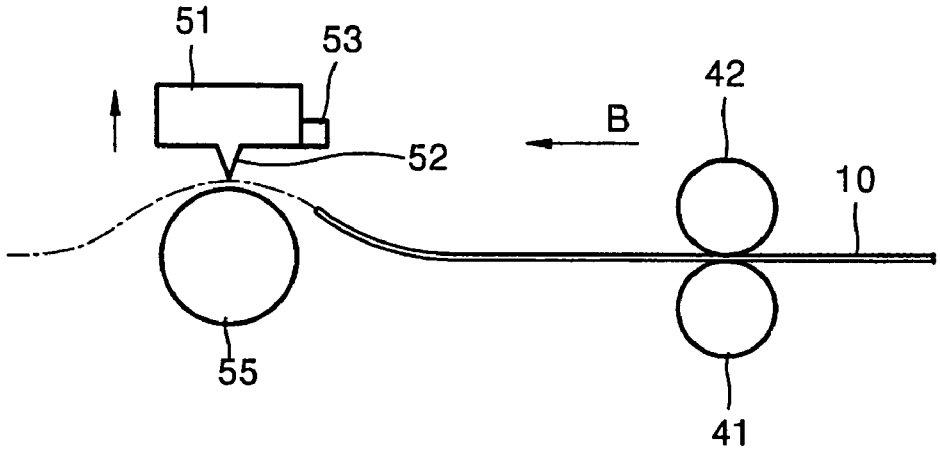
FIGS. 6A through 6D are schematic views illustrating a printing process using the image aligning method of FIG. 5.

In step 103, the optical sensor 53, that is, the edge detection sensor installed on the TPH 51 detects a front edge portion of the medium 10. FIG. 6A shows the detection of an edge of the backfed medium 10 by the optical sensor 53. Here, the TPH 51 is separated by a predetermined height from the medium feeding path.

In step 103, when the front edge of the medium 10 is detected, the edge detection sensor 53 transmits an edge detection signal to the controller 80.

Figure 6B:
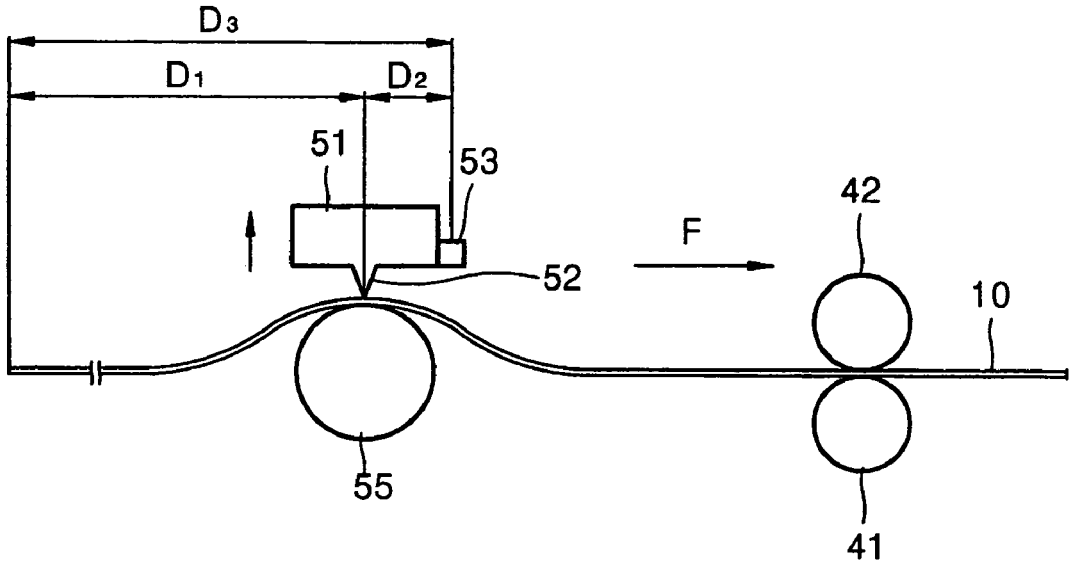

In addition, the controller 80 moves the medium 10 in the backfed direction as much as a first distance D1 from the heating element 52 of the TPH 51, as shown in FIG. 6B (step 104).

If a second distance D2, that is, a distance between the edge detection sensor 53 and the heating element 52 of the TPH 51, is stored in the controller 80, the controller 80 backfeeds the medium 10 as much as a third distance D3 (first distance D1+second distance D2) to the feeding roller 41 since the edge of the medium 10 is detected. In addition, the medium 10 that is backfed to be separated the first distance D1 from the TPH 51 by the feeding roller 41 is stopped. FIG. 6B shows the state that the medium 10 is backfed as much as the third distance D3 from the optical sensor 53. Here, the region of first distance D1 is the region where the printing operation is performed.

Then, the TPH 51 is moved toward the medium 10, and the feeding roller 51 is reversely rotated to forwardly feed the medium 10 in the direction indicated by arrow F while the image forming process for the first surface (the upper surface in the drawings) is performed using the TPH 51 (step 105). Here, the medium 10 is conveyed toward the third path.

Then, in step 106, the edge of the medium 10, which is in the process of forward feeding, is detected by the optical sensor 53. The detection of the edge is performed after the image forming process for the first surface is completed.

Figure 6C:
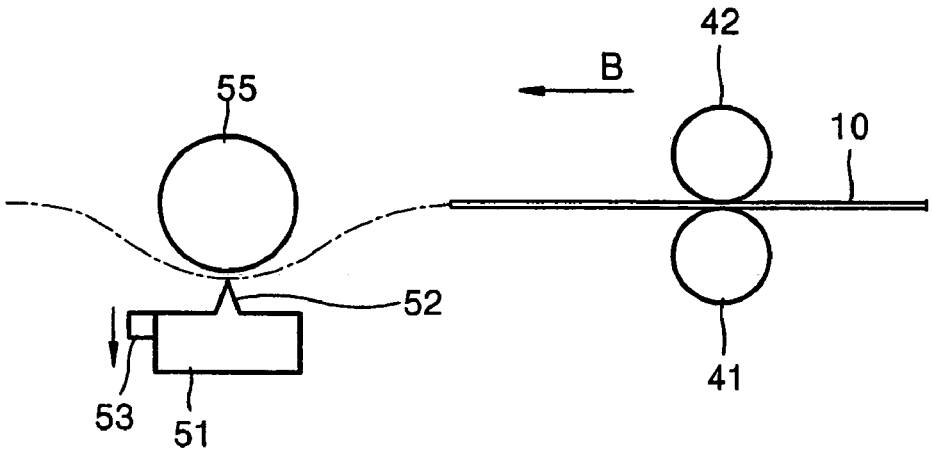

When the edge of the medium 10 is detected in step 106, the controller 80 proceeds the feeding roller 41 a predetermined distance further since the edge has been detected, and then, the controller 80 stops the feeding of the medium 10 and rotates the image forming unit 50 to inverse the position or location of the TPH 51 so that the TPH 51 faces the second surface of the medium 10 (step 107). FIG. 6C shows the state where the position of the TPH 51 is inversed. Here, the medium 10 is not touched by the image forming unit 50 that has been rotated.

In addition, in step 108, the TPH 51 is moved toward the platen roller 55 to form a gap through which the medium 10 may pass without resistance between the platen roller 55 and the TPH 51. After that, the medium 10 is backfed to the second path to prepare the image forming process of the second surface by the conveying unit 40.

In step 109, the front edge of the medium 10 is detected again by the edge detection sensor 53 at the TPH 51.

When the front edge of the medium 10 is detected in step 109, the edge detection sensor 53 transmits an edge detection signal to the controller 80.

Figure 6D:
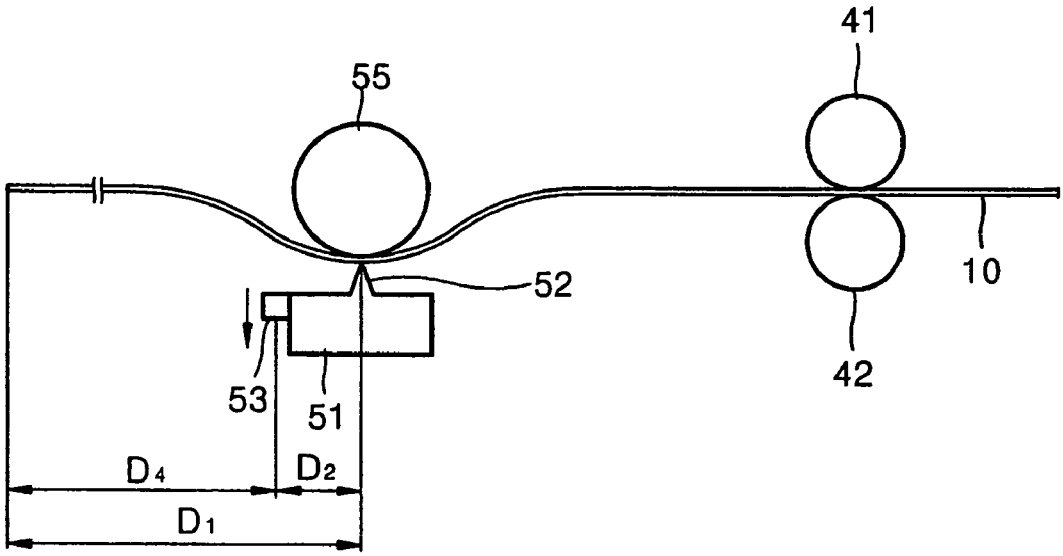

In addition, if the second distance D2 between the edge detection sensor 53 and the heating element 52 of the TPH 51 is stored in the controller 80, the controller backfeeds the medium 10 as much as a fourth distance D4 (first distance D1−second distance D2) between the front edge of the medium 10 and the heating element 52 of the TPH 51, by the feeding roller 41 (step 110). Next, the medium 10 that is backfed to be separated the first distance D1 from the TPH 51 by the feeding roller 41 is stopped. FIG. 6D shows the medium 10 that is backfed as much as the first distance D1 from the heating element 52.

The TPH 51 is moved toward and adhered to the medium 10. The medium 10 is fed forwardly by the feeding roller 41 and the image forming process for the second surface (lower surface in the drawings) of the medium 10 is performed using the TPH 51 (step 111). Here, the medium 10 is fed toward the third path.

When the image forming process for the second surface of the medium 10 is completed, the medium feeding operation by the conveying unit 40 is terminated, and the medium 10 is moved by the medium discharging unit 60 to be discharged out of the printer (step 112).

Figure 7:
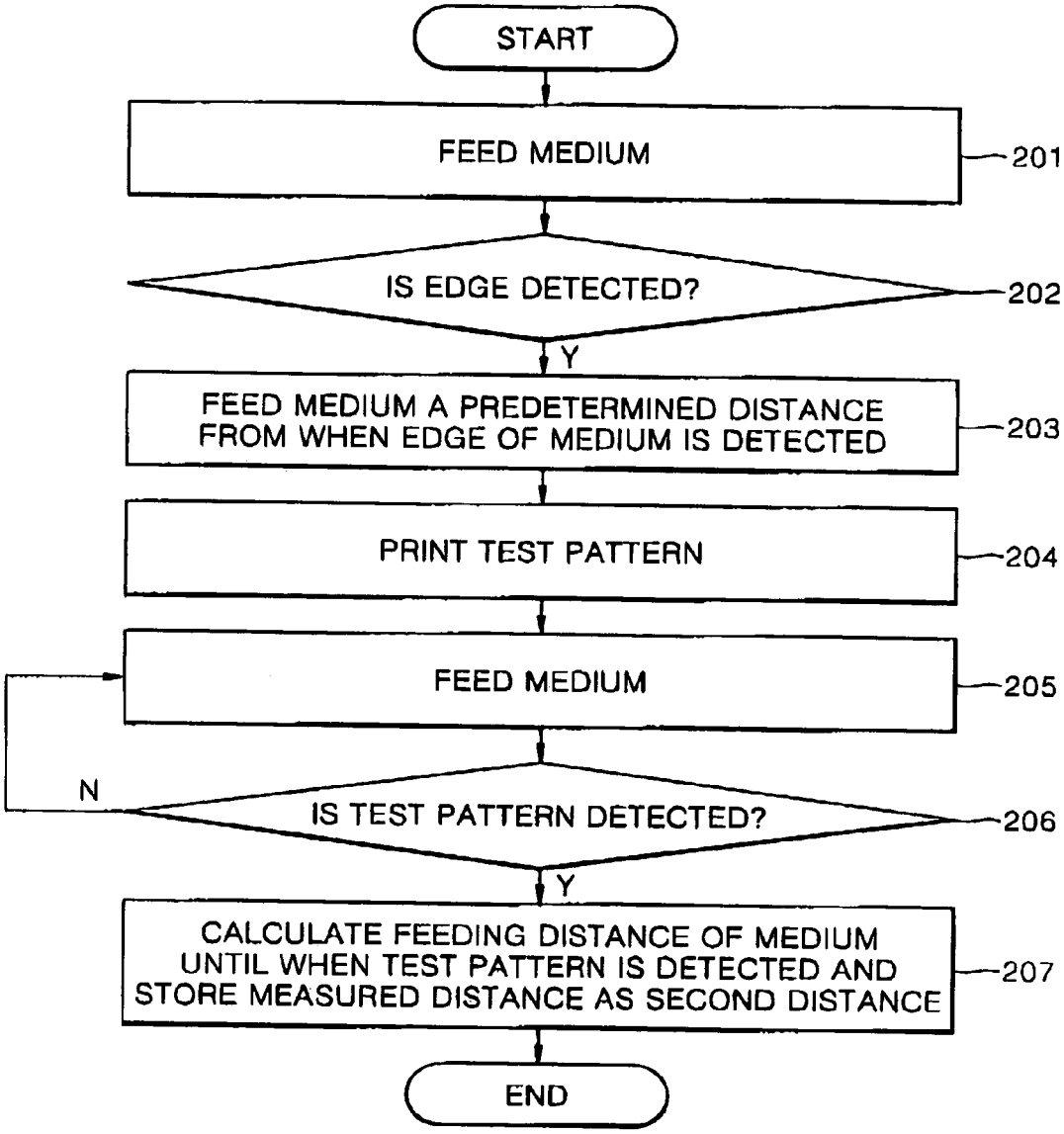
FIG. 7 is a flow chart illustrating a method of measuring a second distance between a heating element of a thermal printhead (TPH) and an edge detection sensor in a case where the edge detection sensor is disposed in front of the TPH on a backfeeding path.

FIG. 7 is a flow chart illustrating a method of measuring the second distance D2 between the heating element 52 of the TPH 51 and the edge detection sensor 53 when the edge detection sensor 53 is disposed on an upstream side of the TPH 51 on the backfeeding path.

When the medium 10 is supplied to the feeding roller 41 after being picked up from the medium container 70, the medium 10 is backfed to the second path (step 201). A position of the medium 10 entering the second path is detected by the rotation of the rotary encoder wheel 45 that is installed on the circumference of the feeding roller 41 using the rotary encoder sensor 46. Here, the generated pulse signals are transmitted to the controller 80, and then, the controller 80 counts the pulse signals to measure the medium conveyed distance of the medium 10.

The edge detection sensor 53 that is installed on a side of the TPH 51 detects the front edge of the entering medium 10 (step 202).

In step 202, when the front edge of the medium 10 is detected, the edge detection sensor 53 transmits the edge detection signal to the controller 80.

In addition, the controller 80 backfeeds the medium 10 by the feeding roller 41 as much as a predetermined distance, for example, the third distance D3 in FIG. 6B since the edge has been detected (step 203).

Figure 8:
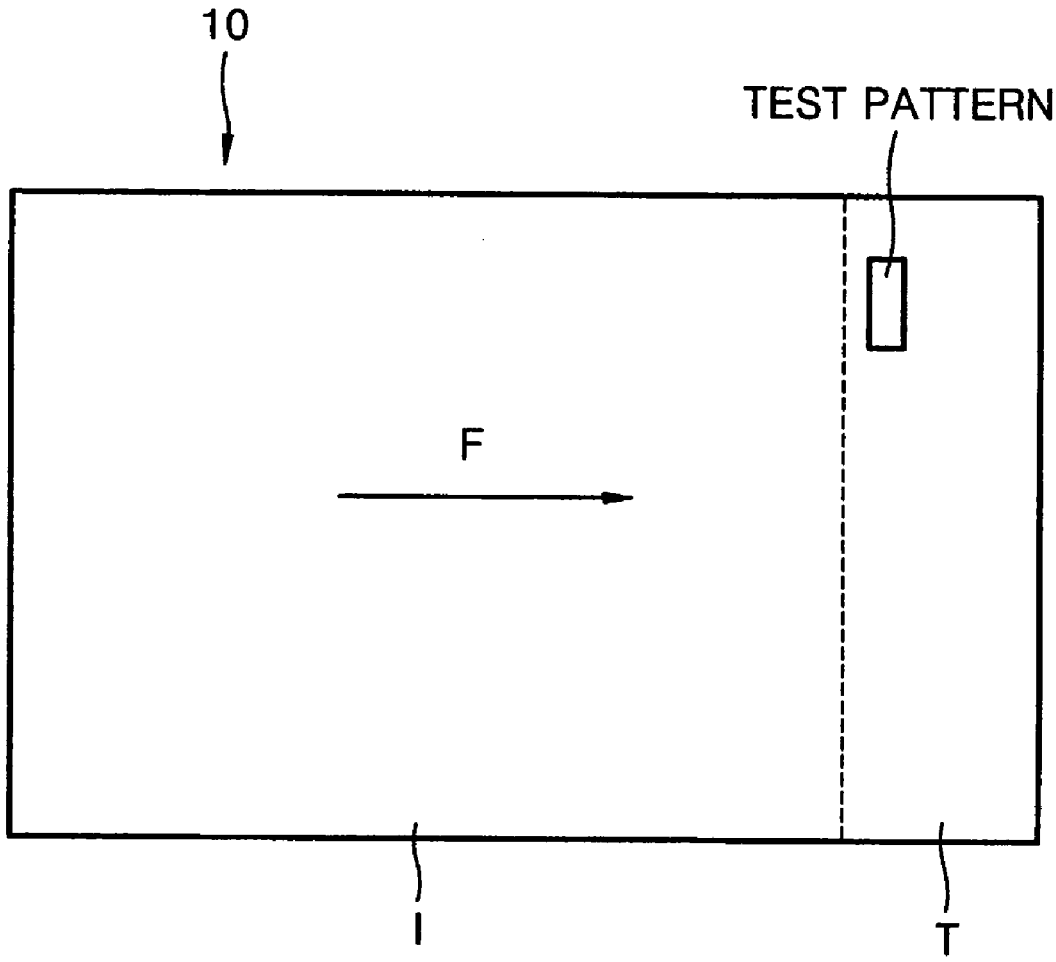
FIG. 8 is a top plan view illustrating a position where a test pattern is printed in FIG. 7.

In step 204, a predetermined test pattern is printed on the medium 10. Here, it is desirable that the portion where the test pattern is printed is not the area I where the image is formed, but a tear-off area T as shown in FIG. 8. That is, since the tear-off area T that is engaged by the feeding roller 41 at the printing start position in the printing direction, in the direction indicated by arrow F, is removed from the image area I after the printing operation is completed, the printing of the test pattern does not affect the image area I. A position of the test pattern is detected by the edge detection sensor 53.

In step 205, the feeding roller 41 is reversely rotated to feed the medium 10 forward and the printing operation is performed. Here, in step 206, the test pattern is detected.

In step 206, when the test pattern is detected, the edge detection sensor 53 transmits a test pattern detection signal to the controller 80. The controller 80 counts the pulse signals from the rotary encoder sensor 46 and calculates the distance of forward feeding until the point when the test pattern is detected, and stores the distance as the second distance D2 (step 207).

Figure 9:
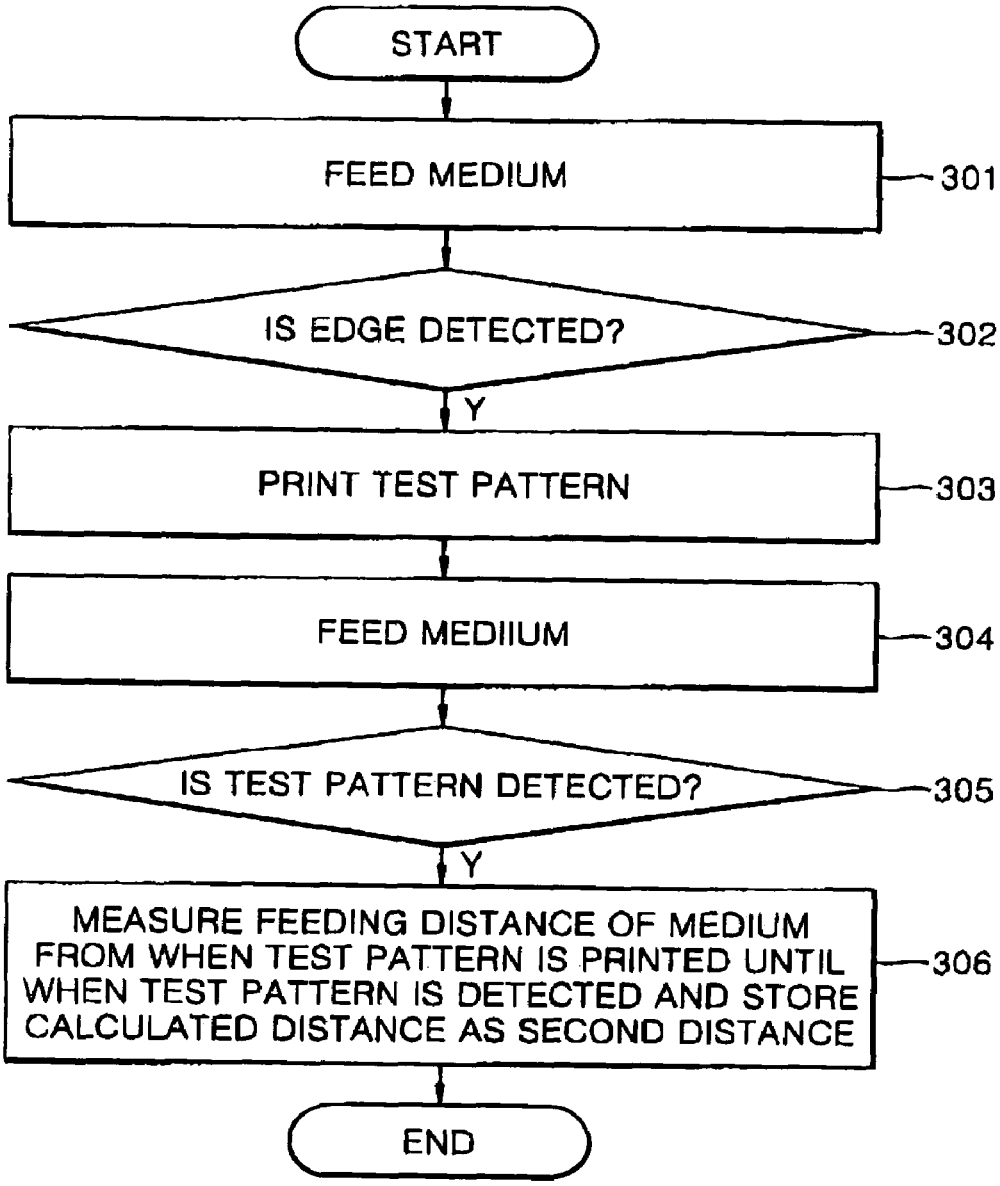
FIG. 9 is a flow chart illustrating a method of measuring a second distance between the heating element of the TPH and the edge detection sensor in a case where the edge detection sensor is disposed rearwardly of the TPH on the backfeeding path.

FIG. 9 is a flow chart illustrating a method of measuring the second distance D2 between the heating element 52 of the TPH 51 and the edge detection sensor 53, as shown in FIG. 6D when the edge detection sensor 53 is disposed at the downstream of the TPH 51 on the backfeeding path.

In step 301, the medium 10 is backfed to the second path in a state that the medium 10 is supplied to the feeding roller 41 after being picked up from the medium container 70. The position of the medium 10 that enters the second path is detected by the rotation of the rotary encoder wheel 45 installed on the circumference of the feeding roller 41 using the rotary encoder sensor 46. When the generated pulse signals are transmitted to the controller 80, the controller 80 counts the pulse signals to measure the conveyed distance.

In addition, in step 302, the edge detection sensor installed on a side of the TPH 51 detects the front edge of the entering medium 10.

In step 302, when the front edge of the medium 10 is detected, the edge detection sensor 53 transmits the edge detection signal to the controller 80.

Then, in step 303, a predetermined test pattern is printed on the medium 10.

The medium 10, on which the test pattern is printed, is backfed to the feeding roller 41 as much as a predetermined distance, for example, the fourth distance D4 in FIG. 6D after detecting the edge (step 304).

In step 304, when the test pattern is detected (step 305), the edge detection sensor 53 transmits the test pattern detection signal to the controller 80, the controller 80 counts the pulse signals from the rotary encoder sensor 46 to calculate the backfeeding distance from the point when the test pattern is printed to the point when the test pattern is detected. The calculated distance is stored as the second distance D2 (step 306).

As described above, when the first surface and the second surface of the thermal imaging medium are printed using one TPH by rotating the image forming unit, the images on the first surface and the second surface may be aligned without regard to the error on the printing path that is generated when the TPH is rotated.

Also, according to the method of aligning images, the alignment may be performed during the printing operation, and an additional time for performing the alignment operation is not required.

The method of the present invention may be applied to a printing apparatus of general purpose, and may be applied effectively to a compact image forming device, specifically a portable printer and a photograph printing operation requiring high definition such as a digital image printer for a digital camera.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of aligning images for a thermal imaging device, the method comprising:

(a) picking up a thermal imaging medium that has a first surface and a second surface on which printing operations may be performed respectively from a medium container, and feeding an edge of the medium a first distance from a heating element of a thermal printhead to a printing path;

(b) forming an image on the first surface of the medium while moving the medium through the printing path;

(c) rotating the thermal printhead to face the thermal printhead toward the second surface of the medium;

(d) feeding the edge of the medium the first distance from the heating element;

(e) forming an image on the second surface of the medium while feeding the medium through the printing path, and (f) measuring a distance between an edge detection sensor that is attached at the thermal printhead and the edge of the medium to make the first distances in step (a) and step (d) substantially equal.

2. The method of claim 1, wherein step (a) comprises:

picking up the medium;

feeding the picked-up medium to the printing path; detecting the edge of the medium using the edge detection sensor; and feeding the medium a third distance when the edge is detected using a second distance between the edge detection sensor and the thermal printhead that is stored in advance to feed the medium the first distance from the heating element of the thermal printhead.

3. The method of claim 2, further comprising attaching the edge detection sensor on the feeding roller side of the thermal printhead, and the third distance is a sum of the first distance and the second distance.

4. The method of claim 3, wherein feeding the medium the first distance by detecting the edge of the medium comprises:

printing a test pattern on the medium by feeding the medium the third distance from the point when the edge is detected;

detecting the test pattern using the edge detection sensor by feeding the medium; and measuring a feeding distance of the medium until the test pattern is detected; and storing the measured distance as the second distance.

5. The method of claim 3, wherein step (d) comprises:

feeding the medium to the printing path by driving the feeding roller;

detecting the edge of the medium using the edge detection sensor;

feeding the medium a fourth distance when the edge is detected, and obtaining the fourth distance by subtracting the second distance from the first distance.

6. The method of claim 2, further comprising positioning the edge detection sensor on an opposite side of the feeding roller, and obtaining the third distance is by subtracting the second distance from the first distance.

7. The method of claim 6, wherein feeding the medium the first distance by detecting the edge comprises:

printing the test pattern on the medium when the edge is detected;

feeding the medium;

detecting the test pattern using the edge detection sensor;

calculating the feeding distance of the medium from the point when the test pattern is printed until the point when the test pattern is detected, and storing the distance as the second distance.

8. The method of claim 6, wherein step (d) comprises:

feeding the medium to the printing path by driving the feeding roller;

detecting the edge of the medium using the edge detection sensor in the feeding process; and feeding the medium a fifth distance from the point when the edge is detected, wherein the fifth distance is a sum of the first distance and the second distance.

9. The method of claim 1, wherein step (b) further comprises:

further moving the medium a predetermined distance on the printing path after detecting the edge.

10. The method of claim 1, further comprising:

discharging the medium after completing the forming of the image on the second surface of the medium.

11. A thermal imaging device, comprising:

a printing assembly including a thermal printhead and a platen roller, the printing assembly being rotatable;

a plurality of heating elements connected to the thermal printhead and directed toward the platen roller;

a sensor connected to the thermal printhead to detect an edge of a medium; and a controller in communication with the sensor and adapted to align the medium in response to signals received from the sensor.

12. The thermal imaging device of claim 11, wherein when the printing assembly is in a first position, a first distance corresponds to an aligned medium position;

a second distance corresponds to the distance between the plurality of heating elements and the sensor; and the third distance is a sum of the first distance and the second distance, wherein the medium is moved the third distance.

13. The thermal imaging device of claim 12, wherein when the printing assembly is rotated about 180 degrees to a second position, the medium is moved a fourth distance that corresponds to the difference between the first distance and the second distance.

* * * * *